US008708150B2

(12) United States Patent
Schütz

(10) Patent No.: US 8,708,150 B2
(45) Date of Patent: Apr. 29, 2014

(54) PALLET-LIKE BASE FRAME FOR TRANSPORT AND STORAGE CONTAINERS FOR LIQUIDS

(75) Inventor: Udo Schütz, Selters (DE)

(73) Assignee: Protechna S.A. (CH)

( * ) Notice: Subject to any disclaimer, the term of this patent is extended or adjusted under 35 U.S.C. 154(b) by 0 days.

(21) Appl. No.: 13/443,539

(22) Filed: Apr. 10, 2012

(65) Prior Publication Data

US 2013/0098801 A1 Apr. 25, 2013

(30) Foreign Application Priority Data

Apr. 18, 2011 (DE) ..... 10 2011 007 587

(51) Int. Cl.
*B65D 25/20* (2006.01)

(52) U.S. Cl.
USPC ..... 206/599; 206/386; 220/9.4

(58) Field of Classification Search
CPC ..... B65D 77/0466; B65D 77/0446; B65D 77/04; B65D 77/061; B65D 77/06; B65D 19/385; B65D 19/02; B65D 25/20
USPC ..... 206/599, 386; 220/9.1, 9.4, 495.05, 1.5, 220/1.6, 485, 647; 108/25
See application file for complete search history.

(56) References Cited

U.S. PATENT DOCUMENTS 6,719,164 B2 * 4/2004 Maschio ..... 220/571
7,762,393 B2 * 7/2010 Schutz ..... 206/386
7,866,501 B2 * 1/2011 Schutz ..... 220/23.91
7,908,980 B2 3/2011 Schmidt et al.

(Continued)

FOREIGN PATENT DOCUMENTS

CN 201553360 U 8/2010
DE 202 17 856 U1 3/2003

(Continued)

OTHER PUBLICATIONS

European Patent Office, European Search Report, Application No. EP 12164351, Sep. 17, 2012.

(Continued)

*Primary Examiner* — Steven A. Reynolds
(74) *Attorney, Agent, or Firm* — Quarles & Brady LLP

(57) ABSTRACT

A pallet-like base frame-includes a floor for supporting the inner container. Corner feet and central feet are mounted on a foot frame attached to the floor of the base frame. At least one of the corner feet includes a corner foot body with a front wall and partial bodies formed laterally of a center axis of the front wall. The partial bodies respectively include an upper supporting surface formed on the circumferential rim of the front wall for connecting the corner foot with the floor and a lower supporting surface with a connecting region for connecting the corner foot with the foot frame. The lower supporting surface of at least one partial body has a stop body arranged between a circumferential rim of the front wall and the connecting region, which stop body, due to its distance from the circumferential rim, defines a bearing rim for supporting the base frame on an outer casing of a transport and storage container.

5 Claims, 2 Drawing Sheets

(56) References Cited

U.S. PATENT DOCUMENTS

| | | | | |
|---|---|---|---|---|
| 2002/0112979 | A1* | 8/2002 | Maschio | 206/386 |
| 2003/0024935 | A1* | 2/2003 | Kind | 220/571 |
| 2004/0149610 | A1* | 8/2004 | Schutz | 206/386 |
| 2005/0092639 | A1* | 5/2005 | Schutz | 206/386 |
| 2005/0133514 | A1* | 6/2005 | Schutz | 220/630 |
| 2005/0196252 | A1* | 9/2005 | Schutz | 411/501 |
| 2009/0212048 | A1* | 8/2009 | Schutz | 220/4.12 |
| 2009/0223847 | A1* | 9/2009 | Schutz | 206/386 |
| 2009/0230017 | A1* | 9/2009 | Schutz | 206/599 |
| 2012/0055830 | A1* | 3/2012 | Schutz | 206/386 |
| 2012/0211395 | A1* | 8/2012 | Schutz | 206/599 |
| 2012/0261303 | A1* | 10/2012 | Schutz | 206/599 |
| 2012/0279898 | A1* | 11/2012 | Schutz | 206/599 |

FOREIGN PATENT DOCUMENTS

| | | | |
|---|---|---|---|
| DE | 20316883 | U1 | 3/2004 |
| DE | 602 00 454 | T2 | 5/2005 |
| DE | 20 2006 001 222 | U1 | 7/2007 |
| EP | 1232961 | A1 | 8/2002 |

OTHER PUBLICATIONS

State Intellectual Property Office of People's Republic of China, First Office Action, Application No. 201210113374.5, Dec. 20, 2013, 8 pages.

* cited by examiner

PALLET-LIKE BASE FRAME FOR TRANSPORT AND STORAGE CONTAINERS FOR LIQUIDS

CROSS REFERENCE TO RELATED APPLICATION

The present application claims the benefit of German Patent Application No. 10 2011 007 587.9 filed Apr. 18, 2011, which is fully incorporated herein by reference.

STATEMENT REGARDING FEDERALLY SPONSORED RESEARCH OR DEVELOPMENT

Not applicable.

FIELD OF THE INVENTION

The present invention relates to a pallet-like base frame, in particular for transport and storage containers for liquids, said containers being equipped with an inner container made of plastic with a closable filling bung and an emptying bung for connection to a withdrawal fitting and an outer casing consisting of a metal grid or sheet, wherein the base frame comprises a floor for supporting the inner container as well as corner feet and central feet mounted on a foot frame and to which the floor of the base frame is attached, wherein the corner feet comprise a corner foot body with a front wall and partial bodies formed laterally of a centre axis of the front wall, wherein the partial bodies respectively comprise an upper supporting surface formed on the circumferential rim of the front wall for connecting the corner foot with the floor and a lower supporting surface with a connecting region for connecting the corner foot with the foot frame.

BACKGROUND OF THE INVENTION

A pallet-like base frame of the kind mentioned in the beginning is known, for example, from the DE 202 17 856 U1. The known base frame comprises corner feet arranged on the corners of the base frame which feet comprise a corner foot body with two partial bodies formed in the area of a centre axis and merging into each other. On the upper rim of the front wall and on the lower rim of the front wall, respectively, the partial bodies comprise an upper supporting surface and a lower supporting surface arranged essentially at right angles to the front wall. The upper supporting surface is used for connection to the floor of the base frame and the lower supporting surface is used for connection to the foot frame of the base frame.

Transport and storage containers of the kind mentioned in the beginning are often arranged in a stacked formation during storing, wherein at least two transport and storage containers are arranged one above the other. In these cases the lower supporting surface of the corner and centre feet serves as a supporting bearing surface for the upper transport and storage container on an upper rim of the outer casing of the lower transport and storage container. Due to the essentially planar form of the lower supporting surfaces the foot frame of the base frame of the upper transport and storage container and the upper rim of the outer casing of the lower transport and storage container extend in a common horizontal plane.

The foot frame of the upper transport and storage container and the upper rim of the lower transport and storage container are, with respect to their dimensions, adapted to match each other in such a way that when stacked the foot frame is situated within certain boundaries defined by the upper rim.

This leads to a certain relative positioning of the upper container in relation to the lower container in a stacked configuration. Due to the unavoidable manufacturing tolerances a not-clearly-defined horizontal distance is provided between the upper rim of the upper container and the foot frame of the lower container in order to ensure that the foot frame of the upper container always fits into the inner area of the upper rim of the lower container when arranged in a stacked configuration. Due to the distance, a more or less accurate positioning of the centres of gravity of the stacked containers on a common vertical axis is in practice only possible if the person operating the fork lift truck or a similar device takes appropriate care. In a case where stacking is not carried out with adequate care and attention, a more or less large horizontal deviation from the centre of gravity of the upper container may arise resulting in a tilting moment effective about a container transverse axis in addition to the vertically acting container load. This tilting moment may, in particular if the container stack is arranged on an uneven foundation or a sloping plane, lead in an extreme case to the stacked configuration becoming unstable and endangering the safety of the stack.

It is, of course, possible to define such narrow limits for the manufacturing tolerances of the foot frame and the upper rim that due to the set minimum distance between the foot frame and the upper rim, only very small horizontal deviations from the centre of gravity of the upper container in relation to the centre of gravity of the upper container are possible. On the other hand, however, there is an increased risk when forming a stacked configuration or dissolving a stacked configuration, that due to the excessively small manufacturing tolerances the foot frame of the upper container and the upper rim of the lower container may become misaligned (jammed) in relation to each other thereby creating dangerous situations which may lead to the upper container falling off and becoming damaged.

SUMMARY OF THE INVENTION

The present invention therefore is based on the object to propose a pallet-like base frame for a transport and storage container for liquids which permits increased stacking safety of the transport and storage container in order to permit the provision of transport and storage containers for liquids which ensure increased safety against container failure due to lack of stability of the stacked configuration thus proving especially suitable for the transportation and storage of dangerous goods.

This object is solved by the base frame according to the invention having a floor for supporting an inner container. Corner feet and central feet are mounted on a foot frame to which the floor of the base frame is attached. At least one of the corner feet includes a corner foot body with a front wall and partial bodies formed laterally of a centre axis of the front wall. The partial bodies respectively include an upper supporting surface formed on a circumferential rim of the front wall for connecting the corner foot with the floor and a lower supporting surface with a connecting region for connecting the corner foot with the foot frame. The lower supporting surface of at least one partial body is provided with a stop body between the circumferential rim of the front wall and the connecting region of the supporting surface, which stop body due to its distance from the circumferential rim defines a bearing rim for supporting the base frame on an outer casing of a transport and storage container.

The base frame according to the invention permits a defined relative configuration of transport and storage containers stacked one above the other due to a stop body arranged on the lower supporting surface between the circumferential rim of the front wall and the connecting region, which stop body, due to its distance from the circumferential rim defines a bearing rim for supporting a lower transport and storage container on an outer casing. In particular the stop bodies arranged on the corner feet permit a quasi-centred arrangement of the upper transport and storage container on the lower transport and storage container such that a defined circumferential distance is created between the foot frame of the upper transport and storage container and the upper rim of the outer casing of the lower transport and storage container thereby avoiding an undesirable misalignment of the transport and storage containers in relation to each other when being stacked, and thereby permitting an easier way of creating a stacked configuration as well as dissolving a stacked configuration with separation of the stacked transport and storage containers from each other and avoiding the creation of correspondingly dangerous situations.

It is particularly advantageous, for a corner foot body formed from metal, to form the stop body as a stop strap formed by bending a partial region of a rim web edge of the lower supporting surface open so that the stop body may be formed integrally with a metal cutting of the corner foot.

When the connecting region is formed by a connecting rim separated from the bearing rim by a stop strap the stop strap simultaneously serves to define the connecting region.

When both partial bodies of the corner feet comprise a stop body arranged on the lower supporting surface, wherein the stop bodies are arranged respectively at a distance from the centre axis of the front wall, a positioning effect may be achieved by just one corner foot when an upper container is placed on a lower container.

BRIEF DESCRIPTION OF THE DRAWINGS

A preferred embodiment of a pallet-like base frame for transport and storage containers will now be described in detail with reference to the drawing, in which.

DETAILED DESCRIPTION OF THE EXAMPLE EMBODIMENTS

Figure 1:
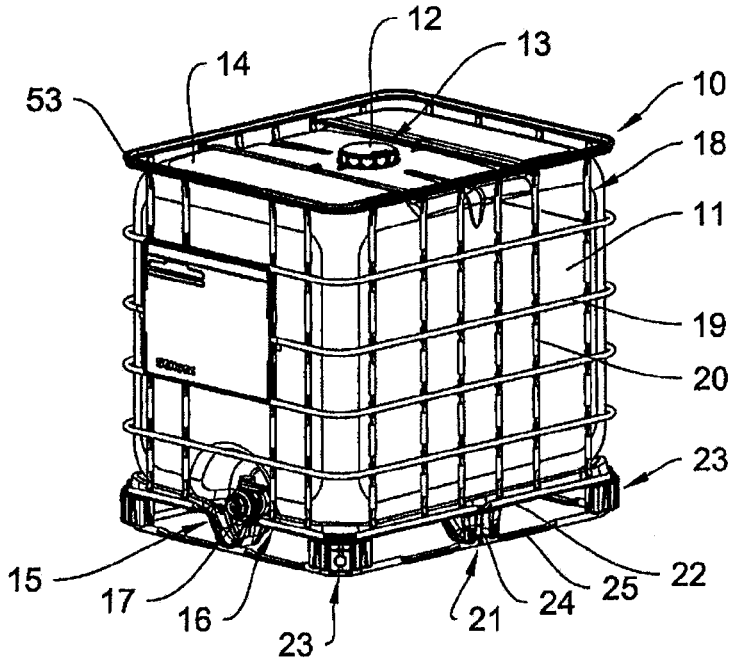
FIG. 1 shows a perspective view of a transport and storage container for liquids equipped with a pallet-like base frame.

FIG. 1 shows a transport and storage container 10 for liquids, which can be used as a one-way or multi-way container and comprising an inner container 11 made of plastic, which is equipped with a filling bung 13 closable by a lid 12 in the upper container floor 14 and an emptying bung 15 in the area of the lower container floor 16 for connection to a withdrawal fitting 17. The inner container 11 is exchangeably received in an outer casing 18 consisting of horizontal and vertical metal grid bars 19, 20 crossing each other, said outer casing being arranged on a pallet-like base frame 21 together with the inner container 11.

The base frame 21 comprises a floor 22 for supporting the inner container 11 as well as the corner feet 23 and centre feet 24 mounted on a foot frame 25, and to which feet the floor 22 as well as the outer casing 18 of the inner container 11 are attached.

Figure 2:
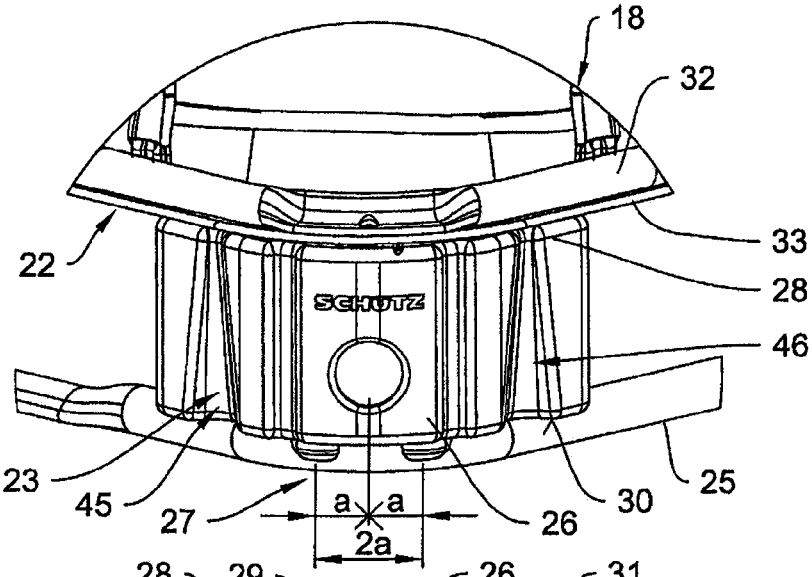
FIG. 2 shows an enlarged view of a corner region of the base frame of the transport and storage container of FIG. 1.
Figure 3:
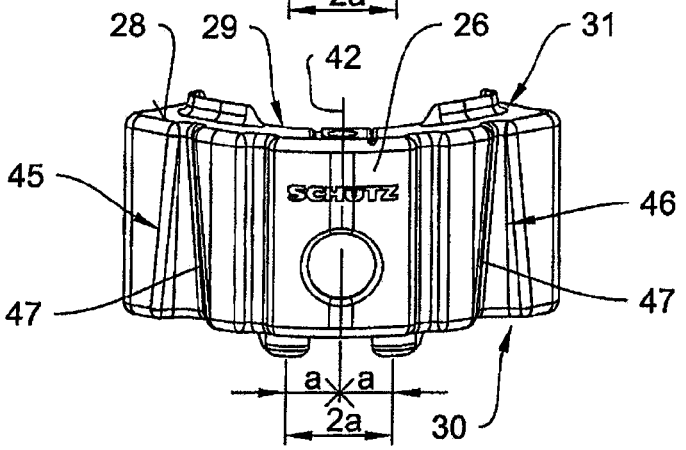
FIG. 3 shows an isometric detail view of a corner foot.

As can be seen when looking at FIGS. 2 and 3 together, the corner foot 23 comprises a front wall 26 which is essentially curved corresponding to a corner radius of the frame corner 27 of the foot frame 25 and at its circumferential rim 28 changes to become a rim web 29 angled towards the inner area of the foot frame 25, which rim web comprises a lower supporting surface formed by the lower rim web portion 30 and an upper supporting surface formed by an upper rim web portion 31. The lower rim web portion 30 is used for connection to the foot frame 25. The upper rim web portion 31 is used for connection to a lower rim 32 of the outer casing 18 such that a circumferential rim 33 of floor 22 is received between the upper rim web portion 31 (FIG. 3) and the lower rim 32 of outer casing 18.

Figure 4:
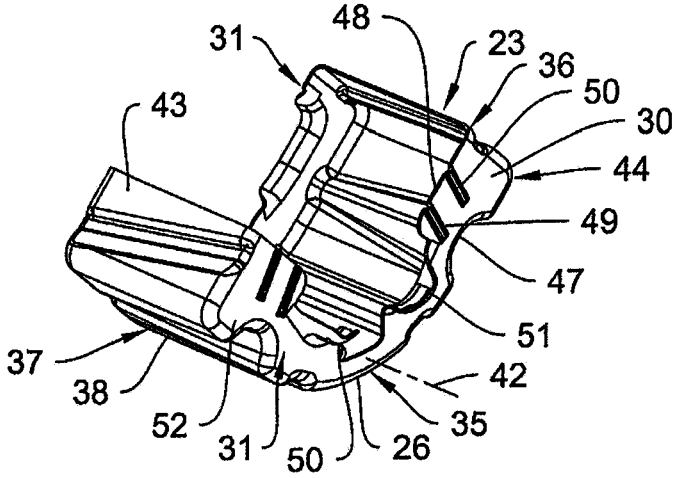
FIG. 4 shows the corner foot shown in detail in FIG. 3 as an isometric view and from below.

As shown in particular in FIG. 4, the corner foot 23 in the shown embodiment comprises an essentially box-shaped or bowl-shaped corner foot body 35 which in the present case is made of metal by a deformation process. The corner foot body 26 consists of two partial bodies 36, 37 connected with each other via the common front wall 26. The partial bodies 36, 37 are each formed laterally of and, in the shown present embodiment, symmetrically to a centre axis 42 of the front wall 26 and continually merging into each other. As also clearly shown in FIG. 4 the partial bodies 36, 37 comprise a lateral rim web portion 43 along the circumferential rim of the front wall 26 adjacent to the lower rim web portion 30 and the upper rim web portion 31, which lateral rim web portion, in the rim web deforming regions 44, changes continually to become the upper rim web portion 31 and the lower rim web portion 30.

Figure 5:
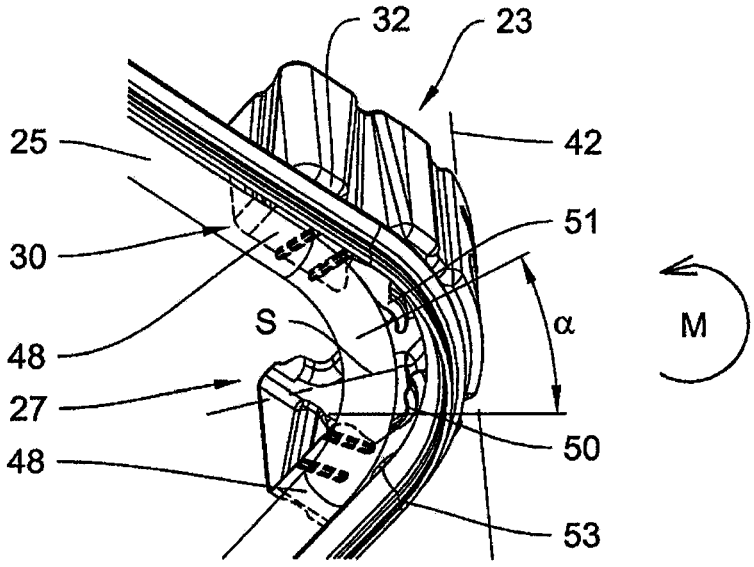
FIG. 5 shows a corner foot in a stacked configuration.

As shown in particular in FIGS. 2 and 3, the front wall 26 is provided with stiffening beads 45, 46 extending between the upper rim web portion 31 and the lower rim web portion 30 and comprising a bead floor 47 which, in relation to a frontal plane defined by front wall 26, is inclined towards a connecting region formed as connecting rim 48 and shown in FIG. 5, of the lower rim web portion 30. In the case of the present embodiment connecting rim 48 respectively comprises two web-shaped welding bumps 49 which are used for manufacturing a welding connection. As shown in particular in FIG. 2, the inclined arrangement of the bead floor 47 permits a direct tilting-moment-free force transfer between the lower rim 32 of outer casing 18 or floor 22 and foot frame 25.

As shown in FIGS. 2 to 5, the partial bodies 36, 37 of corner foot 23 are respectively provided on the lower rim web portion 30 with a stop body formed as a stop strap 50, 51, wherein each stop strap is arranged at a distance a from the centre axis 42 so that the stop straps 50, 51 are arranged at a distance 2*a* from each other on both sides of a corner apex S of the frame corner and, in the present case, symmetrically to apex S of the frame corner.

The arrangement shown in FIG. 5 of the corner foot 23 in a stacked configuration, i.e. where the corner feet 23 of an upper transport and storage container 10 are arranged on an upper rim 53 (see FIG. 1) of outer casing 18 of a lower transport and storage container 10, highlights the fact that the stop straps 50, 51 separate a bearing rim 52 of the lower rim web portion 30 from the connecting rim 48 of the lower rim web portion 30 which is used as a welding connection with the foot frame 25. The stop straps 50, 51 are formed such that they define the distance of the upper rim 53 of outer casing 18 of the lower transport and storage container 10 from the foot frame 25 of the upper transport and storage container 10 arranged thereon in a stacked configuration. An arrangement of the stop straps 50, 51 on all four corner feet of the transport and storage container would thus result in a circumferentially extending, defined free distance of the foot frame 25 of the upper transport and storage container 10 from the upper rim 53 of the lower transport and storage container 10.

Since the base frame shown in FIG. 1 is provided on all four frame corners 27 with corner feet 23, one stop strap at each corner foot for a minimal configuration of the corner feet is sufficient for achieving a defined relative positioning of transport and storage containers in a stacked configuration.

The above described design of the corner foot 23 with two stop straps 50, 51 each, however, already permits a relative alignment in a case where due to an alignment inclined towards the horizontal of a transport and storage container, the corner feet of the upper container are not placed simultaneously on the upper rim 53 of the lower container while forming a stacked configuration, because the stop straps 50, 51 spaced apart by the distance 2*a* (FIG. 2) form a moment support for a supporting moment M (FIG. 5) when abutting against the upper rim 53.

In deviation from the illustrated embodiment it is also possible to form the corner foot body from plastic so that the corner foot body with the formed-on stop straps can be manufactured by the injection moulding process, for example.

The invention claimed is:

1. A pallet-like base frame, in particular for transport and storage containers for liquids, equipped with an inner container made of plastic with a closable filling bung and an emptying bung for connection to a withdrawal fitting and an outer casing consisting of a metal grid or sheet, wherein the base frame comprising:

a floor for supporting the inner container; and corner feet and central feet mounted on a foot frame and to which the floor of the base frame is attached, wherein at least one of the corner feet comprise a corner foot body with a front wall and partial bodies formed laterally of a centre axis of the front wall, wherein the partial bodies respectively comprise an upper supporting surface formed on a circumferential rim of the front wall for connecting the corner foot with the floor and a lower supporting surface with a welding connecting region for connecting the corner foot with the foot frame, wherein the lower supporting surface of at least one partial body has a stop body arranged between the circumferential rim of the front wall and the welding connecting region, which stop body, due to its distance from the circumferential rim, defines a bearing rim for supporting the base frame, the corner foot body being formed from metal including the stop body in the form of an integral stop strap formed from said lower supporting surface by cutting a partial region of a rim web edge of the lower supporting surface and bending the stop strap formed from said partial region of said rim web edge into a downwardly extending position.

2. The base frame according to claim 1 in which the connecting region is formed by a connecting rim separated by the stop strap from the bearing rim.

3. The base frame according to claim 1, in which the partial bodies comprise a stop body arranged on the lower supporting surface, wherein the stop bodies are respectively arranged at a distance from a centre axis of the front wall.

4. A transport and storage container for liquids equipped with an inner container made of plastic with a closable filling bung and an emptying bung for connection to a withdrawal fitting as well as an outer casing consisting of a metal grid or sheet, wherein the inner container and the outer casing are arranged on a floor of a pallet-like base frame according to claim 1.

5. A pallet-like base frame, in particular for transport and storage containers for liquids, equipped with an inner container made of plastic with a closable filling bung and an emptying bung for connection to a withdrawal fitting and an outer casing consisting of a metal grid or sheet, wherein the base frame comprising:

a floor for supporting the inner container;

a foot frame attached to the floor; and corner feet mounted on the foot frame, at least one of the corner feet including a metal corner foot body having a front wall and partial bodies formed laterally of a center axis of the front wall, wherein the partial bodies respectively comprise an upper supporting surface formed on a circumferential rim of the front wall connecting the corner foot with the floor and a lower supporting surface, said lower supporting surface including a rim web edge and a welding connecting region connecting the corner foot with the foot frame, wherein the lower supporting surface of at least one partial body has an integral stop strap formed from said lower supporting surface by cutting a partial region of the rim web edge of the lower supporting surface and bending said partial region of said rim web edge into a downwardly extending position, said stop strap being arranged between the circumferential rim of the front wall and the welding connecting region and defining a bearing rim for supporting the base frame.

* * * * *